US006893514B2

(12) United States Patent
Usami et al.

(10) Patent No.: US 6,893,514 B2
(45) **Date of Patent: *May 17, 2005**

(54) HIGH-MECHANICAL STRENGTH COPPER ALLOY

(75) Inventors: Takayuki Usami, Tokyo (JP); Takao Hirai, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/966,389

(22) Filed: Sep. 27, 2001

(65) Prior Publication Data

US 2002/0119071 A1 Aug. 29, 2002

(30) Foreign Application Priority Data

Dec. 15, 2000 (JP) ..... 2000-381863

(51) Int. Cl.[7] ..... C22C 9/06; C22F 1/08

(52) U.S. Cl. ..... 148/433; 420/476

(58) Field of Search ..... 148/433; 420/476

(56) References Cited

U.S. PATENT DOCUMENTS

| | | | | |
|---|---|---|---|---|
| 4,362,579 | A | 12/1982 | Tsuji | |
| 4,594,221 | A | 6/1986 | Caron et al. | |
| 4,612,167 | A | 9/1986 | Watanabe et al. | 420/471 |
| 4,656,003 | A | 4/1987 | Miyafuji et al. | 420/473 |
| 4,687,633 | A | 8/1987 | Miyafuji et al. | 420/481 |
| 4,728,372 | A | 3/1988 | Caron et al. | |
| 4,877,577 | A | 10/1989 | Futatsuka et al. | |
| 5,028,391 | A | 7/1991 | Ingerson | |
| 5,334,346 | A | 8/1994 | Kim et al. | |
| 5,463,247 | A | 10/1995 | Futatsuka et al. | |
| 5,833,920 | A | 11/1998 | Nakanishi et al. | 420/477 |
| 5,846,346 | A | 12/1998 | Lee et al. | 148/433 |
| 6,040,067 | A | 3/2000 | Sugawara et al. | 428/647 |
| 2003/0165708 | A1 | 9/2003 | Usami et al. | |
| 2004/0045640 | A1 | 3/2004 | Usami et al. | |

FOREIGN PATENT DOCUMENTS

| | | |
|---|---|---|
| EP | 0 501 438 | 9/1992 |
| EP | 0 949 343 | 10/1999 |
| JP | 59-193233 | 11/1984 |
| JP | 61-127842 | 6/1986 |
| JP | 63-130739 | 6/1988 |

(Continued)

OTHER PUBLICATIONS

U.S. Appl. No. 10/354,151.
U.S. Appl. No. 10/602,646.
Synopses of the 38$^{th}$ Symposium of Copper and Brass Technical Research Association, published on Sep. 22, 1998, w/English Translation.
Synopses of the 40$^{th}$ Symposium of Copper and Brass Technical Research Association, published Sep. 20, 2000, w/English Translation.

(Continued)

*Primary Examiner*—Sikyin Ip
(74) *Attorney, Agent, or Firm*—Westerman, Hattori, Daniels & Adrian, LLP

(57) ABSTRACT

A high-mechanical strength copper alloy, which comprises Ni 3.5 to 4.5% by mass, Si 0.7 to 1.0% by mass, Mg 0.01 to 0.20% by mass, Sn 0.05 to 1.5% by mass, Zn 0.2 to 1.5% by mass, and S less than 0.005% by mass (including 0% by mass), with the balance being made of Cu and inevitable impurities, wherein a crystal grain diameter is from more than 0.001 mm to 0.025 mm; and the ratio (a/b), between a longer diameter a of a crystal grain on a cross section parallel to a direction of final plastic-working, and a longer diameter b of a crystal grain on a cross section perpendicular to the direction of final-plastic working, is 1.5 or less, and wherein the alloy has a tensile strength of 800 N/mm$^2$ or more.

9 Claims, 1 Drawing Sheet

FOREIGN PATENT DOCUMENTS

| | | | |
|---|---|---|---|
| JP | 01-180932 | | 7/1989 |
| JP | 2-118037 | | 5/1990 |
| JP | 2-170937 | | 7/1990 |
| JP | 0 440 548 | | 8/1991 |
| JP | 3-188247 | | 8/1991 |
| JP | 5-1367 | | 1/1993 |
| JP | 5-59468 | | 3/1993 |
| JP | 05-059468 | | 3/1993 |
| JP | 5-311278 | | 11/1993 |
| JP | 5-345941 | | 12/1993 |
| JP | 6-41660 | | 2/1994 |
| JP | 06041660 | * | 2/1994 |
| JP | 06-100983 | | 4/1994 |
| JP | 07-054079 | | 2/1995 |
| JP | 7-90520 | | 4/1995 |
| JP | 7-090520 | | 4/1995 |
| JP | 10-330867 | | 12/1998 |
| JP | 11-043731 | | 2/1999 |
| JP | 11043731 | * | 2/1999 |
| JP | 11-140569 | | 5/1999 |
| JP | 11-222641 | | 8/1999 |
| JP | 11-256256 | | 9/1999 |
| JP | 2002-38228 | | 2/2002 |
| JP | 2002-180161 | | 6/2002 |
| JP | 2002-339029 | | 11/2002 |
| JP | 3094045 | | 3/2003 |
| TW | 448235 | | 8/2001 |

OTHER PUBLICATIONS

33rd Annual IICIT, 2000 Conference Proceeding of Oct. 23, 2000.

U.S. Appl. No. 10/005,880, filed Nov. 2, 2000, Usami, et al.

Journal of the Japan Copper and Brass Research Association, 2001, vol. 40, with concise explanation thereof.

Furukawa Electric Review, No. 107, Jan. 2001, with concise explanation thereof.

* cited by examiner

HIGH-MECHANICAL STRENGTH COPPER ALLOY

FIELD

The present invention relates to a high-mechanical strength copper alloy.

BACKGROUND

In accordance with recent trends for miniaturizing and making electric and electronic machinery and tools of high performance, materials for components, such as connectors to be used therein, have been required to be improved in every characteristic strictly.

Concretely, for example, the thickness of a sheet to be used at the contact point of a spring of a connector, has become so thin that it is difficult to ensure sufficient contact pressure. That is, in the contact point of a spring of a connector, generally, a contact pressure required for electrical connection is obtained from counterforce obtained by previously deflecting a sheet (a spring sheet). Therefore, a larger degree of deflecting is needed to obtain the same degree of contact pressure when the sheet is thinned. However, the sheet may undergo plastic deformation when the deflecting degree exceeds the elasticity limit of the sheet. Accordingly, additional improvements of the elasticity limit of the sheet have been required.

A variety of other characteristics, such as stress relaxation property, heat conductivity, bending property, heat resistance, plate adhesion property, and migration resistant property, have also been required for the material of the spring contact point of the connector. Mechanical strength, stress relaxation, heat and electric conductivity, and bending property are important, among the various characteristics.

While phosphor bronze has been frequently used for the spring contact point of the connector, it cannot completely satisfy the requirements described above. Accordingly, phosphor bronze is being replaced by a beryllium-copper alloy (an alloy prescribed in JIS C 1753) in recent years, which has higher mechanical strength and a good stress relaxation property, as well as good electric conductivity. However, the beryllium-copper alloy is very expensive, and metallic beryllium is toxic.

For these reasons, an inexpensive and highly safety material having the same level of characteristics as the beryllium-copper alloy has been urgently desired for use as the contact point material. Among various materials, a Cu—Ni—Si alloy relatively high in mechanical strength has been noted, and many investigations have been made since the latter half of the 1980s.

Unfortunately, the Cu—Ni—Si alloys developed during these years cannot serve as substitutes for the beryllium-copper alloy, considering copper alloys employed now. The reason is probably assumed to inferior mechanical strength and stress relaxation of the Cu—Ni—Si alloy compared with the beryllium-copper alloy.

Besides, a copper alloy in which stress relaxation of the Cu—Ni—Si alloy is improved, by adding Mg, has been proposed for use as the contact point material, but the same level of stress relaxation as the beryllium-copper alloy cannot be obtained by merely adding Mg, and innovative technologies are still required.

SUMMARY

The present invention is a high-mechanical strength copper alloy that comprises 3.5 to 4.5% by mass of Ni, 0.7 to 1.0% by mass of Si, 0.01 to 0.20% by mass of Mg, 0.05 to 1.5% by mass of Sn, 0.2 to 1.5% by mass of Zn, and less than 0.005% by mass (including 0% by mass) of S, with the balance being made of Cu and inevitable impurities, wherein a diameter of a crystal grain in the alloy is from more than 0.001 mm to 0.025 mm; and the ratio (a/b), between a longer diameter a of a crystal grain on a cross section parallel to a direction of final plastic working, and a longer diameter b of a crystal grain on a cross section perpendicular to the direction of final plastic working, is 1.5 or less, and wherein the alloy has a tensile strength of 800 N/mm$^2$ or more.

Further the present invention is a high-mechanical strength copper alloy that comprises 3.5 to 4.5% by mass of Ni, 0.7 to 1.0% by mass of Si, 0.01 to 0.20% by mass of Mg, 0.05 to 1.5% by mass of Sn, 0.2 to 1.5% by mass of Zn, and 0.005 to 2.0% by mass in the sum total of at least one element selected from the group consisting of 0.005 to 0.3% by mass of Ag, 0.005 to 2.0% by mass of Co and 0.005 to 0.2% by mass of Cr, and less than 0.005% by mass (including 0% by mass) of S, with the balance being made of Cu and inevitable impurities, wherein a diameter of a crystal grain in the alloy is from more than 0.001 mm to 0.025 mm; and the ratio (a/b), between a longer diameter a of a crystal grain on a cross section parallel to the direction of final plastic working, and a longer diameter b of a crystal grain on a cross section perpendicular to the direction of final plastic working, is 1.5 or less, and wherein the alloy has a tensile strength of 800 N/mm$^2$ or more.

Other and further features and advantages of the invention will appear more fully from the following description, take in connection with the accompanying drawing.

DETAILED DESCRIPTION

Figure 1:
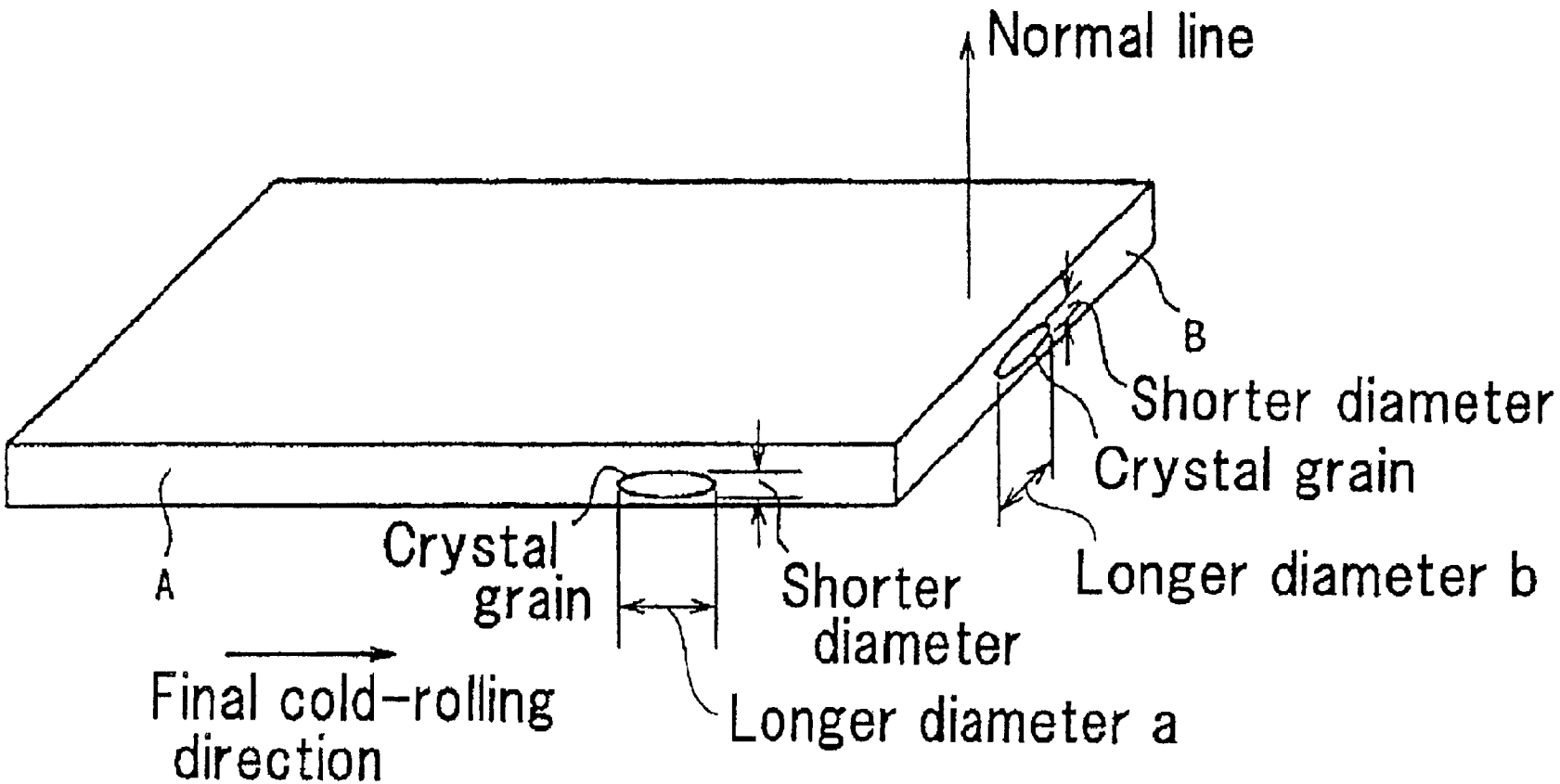
FIG. 1 is an explanatory view on the method for determining the crystal grain diameter and the crystal grain shape, each of which is defined in the present invention.

According to the present invention, there are provided the following means:

(1) A high-mechanical strength copper alloy, comprising 3.5 to 4.5% by mass of Ni, 0.7 to 1.0% by mass of Si, 0.01 to 0.20% by mass of Mg, 0.05 to 1.5% by mass of Sn, 0.2 to 1.5% by mass of Zn, and less than 0.005% by mass (including 0% by mass) of S, with the balance being made of Cu and inevitable impurities, wherein a diameter of a crystal grain in the alloy is from more than 0.001 mm to 0.025 mm; and the ratio (a/b), which defines the shape of crystal grain, between a longer diameter a of a crystal grain on a cross section parallel to a direction of final plastic working, and a longer diameter b of a crystal grain on a cross section perpendicular to the direction of final plastic working, is 1.5 or less, and wherein the alloy has a tensile strength of 800 N/mm$^2$ or more.

(2) A high-mechanical strength copper alloy, comprising 3.5 to 4.5% by mass of Ni, 0.7 to 1.0% by mass of Si, 0.01 to 0.20% by mass of Mg, 0.05 to 1.5% by mass of Sn, 0.2 to 1.5% by mass of Zn, and further 0.005 to 2.0% by mass in the sum total of at least one element selected from the group consisting of 0.005 to 0.3% by mass of Ag, 0.005 to 2.0% by mass of Co and 0.005 to 0.2% by mass of Cr, and less than 0.005% by mass (including 0% by mass) of S, with the balance being made of Cu and inevitable impurities, wherein a diameter of a crystal grain in the alloy is from more than 0.001 mm to 0.025 mm; and the ratio (a/b), which defines the shape of crystal grain, between a longer diameter a of a crystal grain on a cross section parallel to a direction of final plastic working, and a longer diameter b of a crystal grain on a cross section perpendicular to the direction of final plastic working, is 1.5 or less, and wherein the alloy has a tensile strength of 800 $N/mm^2$ or more.

The present invention will be described in more detail hereinafter.

The present invention is a copper alloy to solve the above-described problems in the conventional techniques, by improving conventionally known Cu—Ni—Si alloys so as to meet the recent needs.

The present invention is a copper alloy particularly preferable as a material in a connector for electronic machinery and tools, and the copper alloy of the present invention is applicable to any material to be used in parts for electric and electronic machinery and tools, which requires such characteristics as high mechanical strength, good conductivity (heat and electric conductivity), bending property, stress relaxation property, and plate adhesion property.

On of the points of the copper alloy of the present invention is that, to a copper alloy in which compounds of Ni and Si are precipitated in a Cu matrix to have a specific mechanical strength and an appropriate electric conductivity, each specific amounts of Sn, Mg and Zn are added, and further the crystal grain diameter is made to be from more than 0.001 mm to 0.025 mm, and simultaneously the ratio (a/b), between the longer diameter a of the crystal grain on the cross section parallel to the direction of final plastic working, and the longer diameter b of the crystal grain on the cross section perpendicular to the direction of final plastic working, is made to be 1.5 or less, thereby improving bending property and stress relaxation characteristics.

The inventors of the present invention have newly found that it is important to strictly control, in a target copper alloy, the contents of Ni, Si, Mg, Sn and Zn, the crystal grain diameter, and the shape of crystal grains, for attaining, particularly, stress relaxation in the same level of or superior to that in the conventional beryllium-copper alloy, and that the desired characteristics cannot be obtained even when only one of these elements does not satisfy the specific definition as in the present invention. The inventors of the present invention, having studied intensively, have completed the present invention based on these findings.

The alloy elements in the copper alloy of the present invention will be described hereinafter.

It is known that a Ni—Si compound (a $Ni_2Si$ phase) is precipitated in a Cu matrix by adding Ni and Si in Cu, to improve mechanical strength and electric conductivity.

The content of Ni is defined in the range of 3.5 to 4.5% by mass in the present invention. This is because a mechanical strength in the same level of or superior to that of the conventional beryllium-copper alloy cannot be obtained when the Ni content is less than 3.5% by mass. On the other hand, when the Ni content exceeds 4.5 by mass, giant compounds that do not contribute to the improvement in mechanical strength are precipitated (recrystallized) during casting or hot-working, not only to fail in obtaining a mechanical strength rewarding the amount of Ni to be added, but also to cause problems of adversely affecting hot-working property and bending property. The Ni content is preferably 3.5 to 4.0% by mass.

Since Si and Ni form a $Ni_2Si$ phase, the optimum amount of Si to be added is determined by determining the amount of Ni. Mechanical strength in the same level of or superior to that of the beryllium-copper alloy cannot be obtained when the Si content is less than 0.7% by mass, similarly in the case when the content of Ni is too small. When the content of Si exceeds 1.0% by mass, on the other hand, the same problems arise as in the case when the content of Ni is too large. The Si content is preferably 0.75 to 0.95% by mass.

The mechanical strength varies depending on the contents of Ni and Si, and stress relaxation is also changed accordingly. Therefore, the contents of Ni and Si should be strictly controlled within the range as defined in the present invention, in order to obtain a stress relaxation property in the same level of or superior to that of the beryllium-copper alloy. In addition, the contents of Mg, Sn and Zn, the crystal grain diameter, and the shape of crystal grain as will be described later should be also appropriately controlled.

Mg, Sn and Zn are important alloy elements that constitute the copper alloy of the present invention. These elements in the alloy are correlated with each other, to realize various excellent characteristics well-balanced.

Mg largely improves stress relaxation, but it adversely affect bending property. The more the content of Mg is, the more the stress relaxation is improved, provided that the Mg content is 0.01% by mass or more. However, the resultant bending property cannot satisfy the required level, if the Mg content is more than 0.2% by mass. The content of Mg should be strictly controlled in the present invention, since precipitation of the $Ni_2Si$ phase far more contribute to the degree of reinforcement as compared with the conventional Cu—Ni—Si alloys, thereby bending property is apt to be poor. The content of Mg is preferably 0.03 to 0.2% by mass.

Sn is able to more improve stress relaxation, mutually correlated with Mg. However, such an improving effect of Sn is not so large as Mg. Sufficient effects for adding Sn cannot be sufficiently appeared when the Sn content is less than 0.05% by mass, while, when the Sn content exceeds 1.5% by mass, electric conductivity decreases conspicuously. The content of sn is preferably 0.05 to 1.0% by mass.

Zn a little improves bending property. When Zn is added in the defined range of 0.2 to 1.5% by mass, bending property in the practically non-problematic level may be achieved even by adding Mg in maximum 0.2% by mass. In addition, Zn improves adhesion property of Sn plate or solder plate, as well as migration resistant characteristics. The effect of adding Zn cannot be sufficiently obtained when the Zn content is less than 0.2% by mass, while, when the Zn content exceeds 1.5% by mass, electric conductivity decreases. The content of Zn is preferably 0.2 to 1.0% by mass.

Sub-component elements such as Ag, Co and Cr that are effective for further improving mechanical strength will be described hereinafter.

Ag has an effect for improving heat resistance and mechanical strength, and for improving bending property by preventing the crystal grains from becoming giant. The content of Ag of less than 0.005% by mass fails in sufficiently exhibiting the effect of adding Ag, while the content of Ag of exceeding 0.3% by mass results in a high manufacturing cost of the alloy, although no adverse effects on resulting characteristics are observed at such a high Ag content. The content of Ag is determined to be within the range of 0.005 to 0.3% by mass, preferably 0.005 to 0.15% by mass, from the viewpoints of the above.

Co forms a compound with Si as Ni does, to improve mechanical strength. The content of Co is defined to be within the range of 0.005 to 2.0% by mass, because the effect of adding Co cannot be sufficiently obtained at a Co content of less than 0.005% by mass, while, when the Co content exceeds 2.0 by mass, bending property decreases. The content of Co is preferably 0.005 to 1.0% by mass. The lower limit value of the Co content is more preferably 0.05% by mass.

Cr forms fine precipitates in Cu, to contribute to the increased mechanical strength. The effect of adding Cr cannot be sufficiently obtained at a Cr content of less than 0.005% by mass, while, when the Cr content exceeds 0.2% by mass, bending property decreases. The content of Cr is defined to be within the range of 0.005 to 0.2% by mass, preferably 0.005 to 0.1% by mass, from the viewpoints of the above.

The sum total content of Ag, Co and Cr when at least two kinds of these elements are simultaneously contained in the alloy, is defined to be within the range of 0.005 to 2.0% by mass, preferably 0.005 to 1.25% by mass, depending on the required characteristics.

The content of S is restricted to be less than 0.005% by mass (including 0% by mass), since hot-working property is worsened by the presence of S. The content of S is particularly preferably less than 0.002% by mass (including 0% by mass).

In the present invention, it is possible to add other elements such as Fe, Zr, P, Mn, Ti, V, Pb, Bi and Al, for example, in the sum total content of 0.01 to 0.5% by mass, in an extent not decreasing essential characteristics such as mechanical strength and electric conductivity.

For example, Mn has an effect to improve hot-working property, and it is effective to add Mn in the range of 0.01 to 0.5% by mass, so as not to decrease electric conductivity.

In the copper alloy of the present invention, the balance of the alloy other than the above component elements is made of cu and inevitable impurities.

The crystal grain diameter and the shape of crystal grain are strictly defined in the present invention, in order to favorably realize the characteristics of the copper alloy having the composition as described in the above.

In the present invention, the crystal grain diameter is defined to be from more than 0.001 mm to 0.025 mm. This is because the recrystallized texture tends to be a mixed grain texture (a texture in which crystal grains different in their sizes are mixed to be present) to decrease bending property and stress relaxation when the crystal grain diameter is 0.001 mm or less, while, when the crystal grain diameter exceeds 0.025 mm, bending property decreases. Herein, the crystal grain diameter is a value measured according to JIS H 0501 (a cutting method).

In the present invention, the shape of the crystal grain is expressed with the ratio (a/b), between the longer diameter a of the crystal grain on the cross section parallel to the direction of final plastic working, and the longer diameter b of the crystal grain on the cross section perpendicular to the direction of final plastic working. The ratio (a/b) is defined to be 1.5 or less, because the stress relaxation decreases when the ratio (a/b) exceeds 1.5.

The stress relaxation tends to be decreased when the ratio (a/b) is less than 0.8. Therefore, the ratio (a/b) is preferably 0.8 or more.

The longer diameter a and the longer diameter b each are determined by an average value obtained from 20 or more crystal grains.

The copper alloy of the present invention can be manufactured, for example, by sequentially carrying out the steps of: hot-rolling of an ingot, cold-rolling, heat treatment for forming a solid solution, heat treatment for aging, final cold-rolling, and low-temperature annealing.

In the present invention, the crystal grain diameter and the shape of the crystal grain can be controlled by adjusting heat-treatment conditions, rolling reduction, direction of rolling, back-tension in rolling, lubrication conditions in rolling, and the number of paths in rolling, in the manufacturing process of the copper alloy.

In a concrete embodiment, the crystal grain diameter and the shape of crystal grain can be controlled as defined, for example, by changing heat-treatment conditions (such as the temperature and period of time in the heat-treatment for forming a solid solution and heat treatment for aging) or by a low reduction in the final cold-rolling.

The direction of final plastic working as used in the present invention refers to the direction of rolling when the rolling is the finally carried out plastic working, or to the direction of drawing when the drawing (linear drawing) is the plastic working finally carried out. The plastic working refers to rolling and drawing, but working for the purpose of leveling (vertical leveling) using, for example, a tension leveler, is not included in this plastic working.

In the present invention, the tensile strength of the copper alloy is defined to be 800 $N/mm^2$ or more, because a tensile strength less than 800 $N/mm^2$ causes decrease of stress relaxation. Although the reason has not been clarified yet, the tensile strength is correlated with stress relaxation, and a lower tensile strength tends to decrease stress relaxation. The tensile strength should be adjusted to be 800 $N/mm^2$ or more, by selecting, for example, rolling conditions, in order to obtain stress relaxation in the same level of or superior to that of the beryllium-copper alloy.

The high-mechanical strength copper alloy of the present invention is excellent in mechanical strength, electric conductivity, bending property, stress relaxation property, and plate adhesion property. Therefore, the copper alloy of the present invention can preferably cope with recent trends of miniaturization and high performance of the parts of electric and electronic machinery and tools. The copper alloy of the present invention is preferable as a material to be used in terminals, connectors and switches, as well as it is preferable as general-purpose conductive materials, for example, for switches and relays. Accordingly, the copper alloy of the present invention exhibits industrially excellent effects.

The present invention will be described in more detail based on the following examples, but the invention is not limited to those.

EXAMPLE

Example 1

Copper alloys each having the composition as defined in the present invention, shown in Table 1 (Nos. A to D), were melted in a microwave melting furnace, to cast into ingots with a thickness of 30 mm, a width of 100 mm and a length of 150 mm, by a DC method, respectively. Then, these ingots were heated at 1,000° C. After holding the ingots at this temperature for 30 minutes, they were hot-rolled to a sheet with a thickness of 12 mm, followed by rapid cooling. Then, both end faces of the hot-rolled sheet each were cut (chamfered) by 1.5 mm, to remove oxidation films. The resultant sheets were worked to a thickness of 0.265 to 0.280 mm by cold rolling (a). The cold-rolled sheets were then heat-treated at a temperature of 875 to 900° C. for 15 seconds, after that, immediately followed by cooling at a cooling rate of 15° C./sec or more. Then, aging treatment was carried out at 475° C. for 2 hours in an inert gas atmosphere, and cold rolling (c) as a final plastic working was carried out thereafter, to adjust to the final sheet thickness of 0.25 mm. After the final plastic working, the samples were then subjected to low-temperature annealing at 350° C. for 2 hours, thereby manufacturing copper alloy sheets, respectively.

Comparative Example 1

Copper alloy sheets with a thickness of 0.25 mm were manufactured by working, in the following conditions, the copper alloys (Nos. A and B) each having the composition defined in the present invention, shown in Table 1, respectively.

The same manufacturing steps in the above Example 1 were employed, from the beginning with the melting to the elimination of oxidation films after the hot-rolling. The resultant sheets were then worked by cold-rolling (a) to a thickness of 0.265 to 0.50 mm, followed by heat-treating for 15 seconds at a temperature of 875 to 925° C. The sheets were, thereafter, immediately cooled at a cooling rate of 15° C./sec or more. Then, a cold-roll step (b) with a rolling reduction of 50% or less was carried out depending on the samples, if necessary. Then the resultant sheets were subjected to, in the same conditions as in the Example 1, the aging treatment in an inert gas atmosphere, the final plastic working (cold-rolling (c), to a final sheet thickness of 0.25 mm), and the low-temperature annealing, thereby manufacturing the copper alloy sheets, respectively.

Comparative Example 2

Copper alloy sheets were manufactured in the same manner as in Example 1, except that copper alloys (Nos. E to M) out of the composition defined in the present invention, as shown in Table 1 were used, respectively.

Comparative Example 3

Copper alloy sheets with a thickness of 0.25 mm were manufactured by working, in the following conditions, the copper alloys (Nos. H and K) out of the composition defined in the present invention, shown in Table 1, respectively.

The same manufacturing steps in the above Example 1 were employed, from the beginning with the melting to the elimination of oxidation films after the hot-rolling. The resultant sheets were then worked by cold-rolling (a) to a thickness of 0.40 to 0.42 mm, followed by heat-treating for 15 seconds at a temperature of 850 to 875° C. The sheets were, thereafter, immediately cooled at a cooling rate of 15° C./sec or more. Then, the resultant sheets were subjected to, in the same conditions as in the Example 1, the aging treatment in an inert gas atmosphere, the final plastic working (cold-rolling (c), to a final sheet thickness of 0.25 mm), and the low-temperature annealing, thereby manufacturing the copper alloy sheets, respectively.

Each copper alloy sheets manufactured in Example 1 and Comparative examples 1 to 3 were tested and evaluated with respect to: (1) crystal grain diameter, (2) crystal grain shape, (3) tensile strength and elongation, (4) electric conductivity, (5) bending property, (6) stress relaxation property, and (7) resistance to peeling plate under heat (plate adhesion property). The conventional beryllium-copper alloy (the alloy prescribed in JIS C 1753) sheet was also tested and evaluated with respect to the same properties as above.

The crystal grain diameter (1) was calculated based on the measurement according to JIS H 0501 (a cutting method).

That is, as shown in FIG. 1, the cross section A parallel to the direction of the final cold-rolling of the sheet (the direction of the final plastic working), and the cross section B perpendicular to the direction of the final cold-rolling, were used as the cross sections for measuring the crystal grain diameter. With respect to the cross section A, the crystal grain diameters were measured in two directions that were the direction parallel to or the direction perpendicular to the final cold-rolling direction on the cross section A, and among the measured values, a larger one was referred to as the longer diameter a, and a smaller one was referred to as a shorter diameter, respectively. With respect to the cross section B, the crystal grain diameters were measured in two directions, one of which was the direction parallel to the direction of the normal line of the sheet surface, and the other of which was the direction perpendicular to the direction of the normal line of the sheet surface, and among the measured values, a larger one was referred to as the longer diameter a, and a smaller one was referred to as a shorter diameter, respectively.

The crystalline texture of the copper alloy sheet was photographed with a scanning electron microscope with a 1000-fold magnification, and line segments with a length of 200 mm were drawn on the resultant photograph, and the number n of the crystal grains cut with (shorter than) the line segment was counted, to determine from the following equation:

$$\text{(the crystal grain diameter)}=\{200\ \text{mm}/(n\times 1000)\}.$$

When the number of the crystal grains shorter than the line segment was less than 20, the crystal grains were photographed with a 500-fold magnification, and the number n of the crystal grains shorter than the line segment with a length of 200 mm was counted, to determine from the following equation:

$$\text{(the crystal grain diameter)}=\{200\ \text{mm}/(n\times 500)\}.$$

(1) The crystal grain diameter is shown by rounding the average value of the four values among the two longer diameters and the two shorter diameters each obtained on the cross sections A and B, to the nearest number that is a product of an integer and 0.005 mm.

(2) The shape of the crystal grain is shown as a value (a/b) that is obtained by dividing the longer diameter a on the cross section A by the longer diameter b on the cross section B.

(3) The tensile strength and the elongation were determined in accordance with JIS Z 2241, using #5 test pieces described in JIS Z 2201, which were formed from each of the sample sheets.

(4) The electric conductivity was determined in accordance with JIS H 0505.

(5) Bending property was evaluated by subjecting each of the sample sheets to a 90° bending test in which the inner bending radius was 0.1 millimeter, and the sample in which no crack was occurred at the bent portion is judged to be good (○), and the sample in which cracks were occurred is judged to be poor (x).

(6) As an index of the stress relaxation property, was determined the stress relaxation ratio (S.R.R.), by applying a one-side holding block method of Electronics Materials Manufacturers Association of Japan Standard (EMAS-3003), wherein the stress load was set so that the maximum surface stress would be 600 N/mm$^2$, and the resultant test piece was maintained in a constant temperature chamber at 150° C. for 1,000 hours. The stress relaxation property is judged to be good when the stress relaxation ratio (S.R.R.) was 10% or less, and it is judged to be poor when the S.R.R. was more than 10%. (7) The plate adhesion property was evaluated in the following manner. A test piece of each of the sample sheets was plated with a eutectic solder of a thickness 3 μm, and the resultant test piece was heated at 150° C. for 1,000 hours in the atmospheric air, followed by 90-degree bending and bending back. After that, the adhesion state of the solder plate at the bent portion was observed with the naked eye. The sample in which no peeling off of the plate was recognized is judged to be good in the adhesion property (○), while the sample in which the plate was peeled off is judged to be poor in the adhesion property (x).

The results are shown in Table 2.

As is apparent from the results shown in Table 2, the sample Nos. 1 to 7, which were the examples according to the present invention, each exhibited excellent properties in all the tested items.

On the contrary, each comparative examples were poor in any of the characteristics, as described below.

The sample No. 8 for comparison was poorly low in tensile strength and also poor in stress relaxation property, which properties were inferior to those of the conventional JIS C1753 alloy, since the contents of Ni and Si were too small in the sample No. 8.

TABLE 1

| | Ingot No. | Ni mass % | Si mass % | Mg mass % | Sn mass % | Zn mass % | S mass % | Other elements mass % |
|---|---|---|---|---|---|---|---|---|
| Example of this invention | A | 3.9 | 0.90 | 0.10 | 0.18 | 0.49 | 0.002 | |
| | B | 4.0 | 0.91 | 0.06 | 0.52 | 0.50 | 0.002 | |
| | C | 3.8 | 0.89 | 0.11 | 0.19 | 0.49 | 0.002 | Ag 0.02 |
| | D | 3.9 | 0.90 | 0.11 | 0.18 | 0.50 | 0.002 | Cr 0.006 |
| Comparative example | E | 3.2 | 0.68 | 0.10 | 0.20 | 0.50 | 0.002 | |
| | F | 5.0 | 1.17 | 0.10 | 0.21 | 0.49 | 0.002 | |
| | G | 3.9 | 0.89 | <0.01 | 0.21 | 0.50 | 0.002 | |
| | H | 3.9 | 0.90 | 0.38 | 0.20 | 0.50 | 0.002 | |
| | I | 4.0 | 0.90 | 0.10 | 0.02 | 0.50 | 0.002 | |
| | J | 3.9 | 0.89 | 0.08 | 2.01 | 0.50 | 0.002 | |
| | K | 3.9 | 0.88 | 0.09 | 0.20 | 0.12 | 0.002 | |
| | L | 3.9 | 0.88 | 0.08 | 0.19 | 0.51 | 0.002 | Cr 0.4 |
| | M | 1.9 | 0.46 | 0.09 | 0.33 | 0.49 | 0.011 | |
| Conventional example | JIS C1753 alloy: Cu-0.3 mass % Be-1.9 mass % Ni-0.5 mass % Al | | | | | | | |

Note)
In the ingot Nos. A to M, the balance was made of Cu and unavoidable impurities.

TABLE 2

| Classification | Ingot No. | Sample No. | Crystal grain diameter (mm) | Shape of crystal grain | Tensile strength (N/mm$^2$) | Elongation (%) | Electric conductivity (% IACS) | Bending property (presence or absence of cracks) | S.R.R. (%) | Peeling of plate |
|---|---|---|---|---|---|---|---|---|---|---|
| Example of this invention | A | 1 | 0.005 | 1.1 | 880 | 12 | 33 | ○ | 8 | ○ |
| | A | 2 | 0.005 | 0.7 | 885 | 11 | 33 | ○ | 10 | ○ |
| | A | 3 | 0.005 | 1.2 | 890 | 10 | 33 | ○ | 9 | ○ |
| | A | 4 | 0.010 | 1.1 | 875 | 12 | 32 | ○ | 7 | ○ |
| | B | 5 | 0.005 | 1.1 | 895 | 11 | 29 | ○ | 7 | ○ |
| | C | 6 | 0.005 | 1.0 | 900 | 12 | 33 | ○ | 8 | ○ |
| | D | 7 | 0.005 | 1.1 | 900 | 10 | 33 | ○ | 8 | ○ |
| Comparative example | E | 8 | 0.005 | 1.1 | 730 | 18 | 39 | ○ | 17 | ○ |
| | F | 9 | The production was stopped and not completed due to occurrence of cracks during hot-working. | | | | | | | |
| | G | 10 | 0.005 | 1.0 | 880 | 12 | 34 | ○ | 19 | ○ |
| | H | 11 | 0.005 | 1.1 | 890 | 10 | 31 | X | 7 | ○ |
| | H | 12 | 0.005 | 1.6 | 910 | 9 | 31 | X | 18 | ○ |
| | I | 13 | 0.005 | 1.1 | 870 | 12 | 35 | ○ | 14 | ○ |
| | J | 14 | The production was stopped and not completed due to occurrence of edge cracks during cold-rolling. | | | | | | | |
| | K | 15 | 0.005 | 1.1 | 885 | 10 | 34 | X | 8 | X |
| | K | 16 | <0.001 | 1.7 | 900 | 8 | 34 | X | 20 | X |
| | L | 17 | 0.005 | 1.0 | 890 | 11 | 33 | X | 7 | ○ |
| | M | 18 | The production was stopped and not completed due to occurrence of cracks during hot-working. | | | | | | | |
| | A | 19 | 0.005 | 1.7 | 910 | 9 | 32 | ○ | 19 | ○ |
| | A | 20 | 0.005 | 2.0 | 920 | 8 | 32 | X | 25 | ○ |
| | A | 21 | 0.030 | 1.1 | 870 | 12 | 33 | X | 7 | ○ |
| | A | 22 | <0.001 | 1.0 | 890 | 10 | 32 | X | 9 | ○ |
| | B | 23 | 0.030 | 2.0 | 925 | 8 | 28 | X | 23 | ○ |
| Conventional example JIS C1753 | | | — | — | 860 | 13 | 33 | ○ | 10 | ○ |

(Note):
Sample Nos. 1 to 7 were produced according to Example 1. Sample Nos. 19 to 23 were produced according to Comparative example 1. Sample Nos. 8 to 11, 13 to 15, 17, and 18 were produced according to Comparative example 2. Sample Nos. 12 and 16 were produced according to Comparative example 3.

The sample No. 9 for comparison could not be normally produced, since cracks were occurred during the hot-working, which were caused by the too large contents of Ni and Si.

The samples No. 10 and No. 13 for comparison were poor in stress relaxation property, since the Mg content in the sample No. 10 and the Sn content in the sample No. 13 each were out of the range defined in the present invention.

The sample No. 11 for comparison was poor in bending property, since the content of Mg was too large.

The sample No. 12 for comparison was poor in bending property as well as stress relaxation property, since the Mg content was too large and the shape of the crystal grains was out of the range defined in the present invention.

The sample No. 14 for comparison could not be produced, since during the cold-rolling were occurred edge cracks, which were caused by the too large content of Sn.

The sample No. 15 for comparison was poor in bending property and peeling off of plate was occurred in said sample, since the content of zn was too small.

The sample No. 16 for comparison was poor in bending property, plate adhesion property (peeling off of plate was occurred), and stress relaxation property, since the content of Zn was too small and in addition the crystal grain diameter and the crystal grain shape each were out of the range defined in the present invention.

The sample No. 17 for comparison was poor in bending property, since the content of Cr was out of the range defined in the present invention.

The sample No. 18 for comparison could not be normally manufactured, since cracks were occurred during the hot-rolling, which were caused by the too large content of S that was out of the range defined in the present invention, as well as by the too small contents of Ni and Si.

The samples No. 19 and No. 20 for comparison each were conspicuously poor in stress relaxation property, since the shape of the crystal grains was out of the range defined in the present invention. In the sample No. 20, bending property was also poor.

The samples of No. 21 and No. 22 for comparison each were poor in bending property, since the crystal grain diameter was out of the range defined in the present invention. The sample No. 23 for comparison was poor in bending property and stress relaxation property, since the crystal grain shape and the crystal grain diameter were out of the range defined in the present invention.

Having described our invention as related to the present embodiments, it is our intention that the invention not be limited by any of the details of the description, unless otherwise specified, but rather be construed broadly within its spirit and scope as set out in the accompanying claims.

What is claimed is:

1. A high-mechanical strength copper alloy, consisting essentially of 3.5 to 4.5% by mass of Ni, 0.7 to 1.0% by mass of Si, 0.01 to 0.20% by mass of Mg, 0.05 to 1.5% by mass of Sn, 0.2 to 1.5% by mass of Zn, and less than 0.005%bymass (including0%bymass) of S, with the balance being made of Cu and inevitable impurities, wherein a diameter of a crystal grain in tne alloy is from more than 0.00 1 mm to 0.025 mm; and the ratio (a/b), between a longer diameter a of a crystal grain on a cross section parallel to a direction of final plastic working, and a longer diameter b of a crystal grain on a cross section perpendicular to the direction of final plastic working, is 1.5 or less, wherein the alloy has a tejisile strength of 800 $N/mm^2$ or more, and wherein the alloy has a stress relaxation ratio of 10% or less.

2. The high-mechanical strength copper alloy as claimed in claim 1, wherein the content of S is less than 0.002% by mass (including 0% by mass).

3. The high-mechanical strenght copper alloy as claimed in claim 1, wherein the ratic (a/b) is 0.8 or more.

4. The high-mechanical strength copper alloy as claimed in claim 1, wherein the alloy consists essentially of 3.5 to 4.0% by mass of Ni, 0.75 to 0.95% by mass of Si, 0.03 to 0.20% by mass of Mg, 0.05 to 1.0% by mass of Sn, 0.2 to 1.0% by mass of Zn, and less than 0.002% by mass (including 0% by mass) of S, with the balance being made of Cu and inevitable impurities.

5. A high-mechanical strength copper alloy, consisting essentially of 3.5 to 4.5% by mass of Ni, 0.7to1.0% by mass of Si, 0.01 to 0.20% by mass of Mg, 0.05 to 1.5% by mass of Sn, 0.2 to 1.5% by mass of Zn, and further 0.005 to 2.0% by mass in the sum total of at least one element selected from the group consisting of 0.005 to 0.3% by mass of Ag, 0.005 to 2.0% by mass of Co and 0.005 to 0.2% by mass of Cr, and less than 0.005% by mass (including 0% by mass) of S, with the balance being made of Cu and inevitable impurities, wherein a diameter of a crystal grain in the alloy is from more than 0.001 mm to 0.025 mm; and the ratio (a/b), between a longer diameter of a crystal grain on a cross section parallel to a direction of final plastic working, and a longer diameter a of a crystal grain on a cross section perpendicular to the direction of final plastic working, is 1.5 or less, wherein the alloy has a tensile strength of 800 N/mm or more, and wherein the alloy has a stress relaxation ratio of 10% or less.

6. The high-mechanical strength copper alloy as claimed in claim 5, wherein the ratio (a/b) is 0.8 or more.

7. The high-mechanical strength copper alloy as claimed in claim 5, wherein the alloy consists essentially of 3.5 to 4.0% by mass of Ni, 0.75 to 0.95% by mass of Si, 0.03 to 0.20% by mass of Mg, 0.05 to 1.0% by mass of Sn, 0.2 to 1.0% by mass of Zn, and further 0.005 to 2.0% by mass in the sum total of at least one element selected from the group consisting of 0.005 to 0.3% by mass of Ag, 0.005 to 2.0% by mass of Co and 0.005 to 0.2% by mass of Cr, and less than 0.002% by mass (including 0% by mass) of S, with the balance being made of Cu and inevitable impurities.

8. The high-mechanical strength copper alloy as claimed in claim 5, wherein the alloy consists essentially of 3.5 to 4.0% by mass of Ni, 0.75 to 0.95% by mass of Si, 0.03 to 0.20% by mass of Mg, 0.05 to 1.0% by mass of Sn, 0.2 to 1.0% by mass of Zn, and further 0.005 to 1.25% by mass in the sum total of at least one element selected from the group consisting of 0.005 to 0.15% by mass of Ag, 0.005 to 1.0% by mass of Co and 0.005 to 0.1% by mass of Cr, and less than 0.002% by mass (including 0% by mass) of S, with the balance being made of Cu and inevitable impurities.

9. The high-mechanical strength copprt alloy as claimed in claim 5, wherein the content of S is less than 0.002% by mass (including 0% by mass).

* * * * *